US005501448A

United States Patent [19]

Mack et al.

[11] Patent Number: 5,501,448

[45] Date of Patent: Mar. 26, 1996

[54] DEVICE FOR REMOVING INSPECTION COPIES AT ROTARY CROSS CUTTERS

[75] Inventors: Richard B. Mack, Brühl; Rainer Klenk, St. Leon-Rot, both of Germany

[73] Assignee: Heidelberger Druckmaschinen AG, Heidelberg, Germany

[21] Appl. No.: 243,852

[22] Filed: May 17, 1994

[30] Foreign Application Priority Data

May 17, 1993 [DE] Germany ..... 43 16 413.7

[51] Int. Cl.[6] ..... B65H 29/00

[52] U.S. Cl. ..... 271/280; 271/303

[58] Field of Search ..... 271/280, 303, 271/305; 83/78, 86, 89, 94; 198/367

[56] References Cited

U.S. PATENT DOCUMENTS

| | | | |
|---|---|---|---|
| 3,542,361 | 11/1970 | Call | 271/280 |
| 4,667,953 | 5/1987 | Hirakawa et al. | 271/280 |
| 4,915,371 | 4/1990 | Quinton | 271/280 |

FOREIGN PATENT DOCUMENTS

| | | | |
|---|---|---|---|
| 0345418 | 12/1989 | European Pat. Off. . | |
| 1113358 | 10/1962 | Germany . | |
| 1786264 | 12/1971 | Germany . | |
| 2330614 | 1/1975 | Germany . | |
| 2430212 | 1/1976 | Germany . | |
| 3029154 | 1/1983 | Germany . | |
| 3010793 | 7/1986 | Germany . | |
| 3527710 | 10/1988 | Germany . | |
| 4020398 | 2/1992 | Germany . | |
| 4-148763 | 5/1992 | Japan | 271/303 |
| 858463 | 1/1961 | United Kingdom . | |
| 1499200 | 1/1978 | United Kingdom . | |
| 2137180 | 10/1984 | United Kingdom . | |

*Primary Examiner*—David H. Bollinger
*Attorney, Agent, or Firm*—Herbert L. Lerner; Laurence A. Greenberg

[57] ABSTRACT

Device for removing inspection or specimen copies at rotary cross cutters or deliveries in sheet-fed presses which, at a cutting station, cut a continuously supplied web of material into individual copies subsequently conveyable substantially free of contact and partly mutually overlapping in a given conveying direction in a copy-transport plane to a decelerating station disposed downline from the cutting station, includes at least one swivel cam assigned to the copy-transport plane, the swivel cam being activatable for penetrating the copy-transport plane so as to change the conveying direction of the copies.

14 Claims, 4 Drawing Sheets

DEVICE FOR REMOVING INSPECTION COPIES AT ROTARY CROSS CUTTERS

The invention relates to a device for removing inspection or specimen copies at rotary cross cutters or deliveries in sheet-fed presses which, at a cutting station, cut a continuously supplied web of material into individual copies, which are subsequently conveyable substantially free of contact and partly mutually overlapping in a copy-transport plane and directable to a decelerating station disposed downline from the cutting station.

Heretofore known from the prior art is published German Patent Document DT 24 30 212 Al, which describes a sorting device in printing presses. In the delivery of a sheet-fed printing press, printing copies are delivered onto different piles depending upon the outcome of an ink-coverage or ink lay-down measurement. Furthermore, the published German Patent Document DE 30 29 154 C2 discloses a waste diverter or ejector wherein a tape or belt section is of such construction that a belt or tape roller which is changeable in position is swingable downwardly and is bringable into engagement with a press-on or feed roller disposed thereabove. This is realized by means of an actuating cylinder which is disposed below the belt or tape section.

In this heretoforeknown device, the transport plane of the copies is deflected accordingly in order to divert or eject waste copies. The waste copies have passed through all of the processing steps and can be separated out only when they are transported farther to a delivery station. It is not possible to remove the inspection copies directly at the processing machine with the equipment which constitutes the subject matter of the aforementioned published German Patent Document DE 30 29 154 C2.

Known heretofore from published German Patent Document DE 40 20 398 C1, is a device for overlapping and delivering sheets which have been cut from a web of material by a cross-cutter. Sheets which have been cut off by a cross-cutting unit are fed via floating bars to a conveying device, downline from which a combined conveying and braking device is disposed. Rotating braking cams press the sheets in a direction towards rotating tapes which are situated above a suction box, thereby decelerating the copies. The copies are then deposited on a sheet pile at a suitable station. A removal of inspection or specimen sheets from the pile which is continuously increased from above at the pile station during the production process has proven to be impractical and time-consuming.

Starting from the state of the prior art outlined hereinbefore, it is accordingly an object of the invention to provide a device for removing inspection or specimen copies at rotary cross cutters wherein a succession of continuously conveyed copies is fed to a readily accessible removal station.

With the foregoing and other objects in view, there is provided, in accordance with the invention, a device for removing inspection or specimen copies at rotary cross cutters or deliveries in sheet-fed presses which, at a cutting station, cut a continuously supplied web of material into individual copies subsequently conveyable substantially free of contact and partly mutually overlapping in a given conveying direction in a copy-transport plane to a decelerating station disposed downline from the cutting station, comprising at least one swivel cam assigned to the copy-transport plane, the swivel cam being activatable for penetrating the copy-transport plane so as to change the conveying direction of the copies.

In accordance with another feature of the invention, the device includes a swivel shaft disposed below the copy-transport plane, the swivel cam being deflectable about the swivel shaft below the copy-transport plane.

In accordance with a further feature of the invention, the swivel cam is formed with a recess.

In accordance with an added feature of the invention, the device includes an actuating head, and actuating means for moving the actuating head, the swivel cam being cooperatively engageable by the actuating head and being movable through the intermediary of the actuating head by the actuating means.

In accordance with an additional feature of the invention, the actuating means comprise an actuating cylinder energizable by a pressure medium.

In accordance with an alternative feature of the invention, the actuating means comprise a control cam, and a roller rollable on the control cam.

In accordance with yet another feature of the invention, the device includes at least another swivel cam disposed adjacent the at least one swivel cam, and a swivellable copy guide located opposite the swivel cams and having an inlet funnel formed thereon.

In accordance with yet a further feature of the invention, the device includes a swivellable copy guide disposed opposite the at least one swivel cam, and a remotely controllable swivelling device operatively engageable with the swivellable copy guide for swivelling the copy guide.

In accordance with yet an added feature of the invention, the device includes a stationary copy guide mounted on the rotary cross cutter, the swivellable copy guide being swivellable into operative alignment with the stationary copy guide.

In accordance with yet an additional feature of the invention, the device includes means for removing copies from an upper part of the rotary cross cutter, the swivellable copy guide being swivellable into operative alignment with the copy-removing means.

In accordance with another feature of the invention, the device includes means for removing copies from a rearward location of the stationary copy guide.

In accordance with a concomitant feature of the invention, the copy-removing means have an opening coverable by a hinged flap.

Thus, at least one swivel cam associated with a copy-transport plane and, when activated, penetrating the copy-transport plane, changes the conveying direction of copies.

An advantage of this construction is that copies can then be diverted directly out of the conveyed stream of copies before they are braked before a piling station and are deposited on top of one another. The kinetic energy inherent in the conveyed copies at the time of the diversion is sufficient to direct the copies to a separate removal station without negatively influencing the further conveyance and deceleration of the copies, which occurs continuously in the copy-transport plane.

In a further development of the concept upon which the invention is based, the swivel cams are deflectable about a swivel shaft below the copy-transport plane and are provided with recesses. Minimum actuating distances are thereby able to be achieved. Furthermore, the space which exists below the copy-transport plane is optimally utilized. The swivel cams are adapted to be moved by an actuating device, which moves an actuating head, an embodiment of the actuating device be in the form of a pressure medium-energized actuating cylinder. An inlet funnel is formed on a swivellable copy guide, opposite the swivel cams. The swivellable copy guide is adjustable through the intermediary of a remotely controllable swivelling device. The swivellable copy guide is adapted to be brought into engagement with a stationary copy guide disposed on the rotary cross cutter and extending parallel to the copy-transport plane. Alternatively, however, the swivellable copy guide is swivellable into a more-or-less vertical position. In this case, it is in engagement with a front removal flap which is formed in an upper part of the rotary cross cutter. If required, further deceleration of copies as they exit from the swivellable copy guide may be effected in the stationary copy guide. The copies are removed from the rotary cross cutter at a rear removal flap or are collected in a separate container.

Other features which are considered as characteristic for the invention are set forth in the appended claims.

Although the invention is illustrated and described herein as embodied in a device for removing inspection copies at a rotary cross cutter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
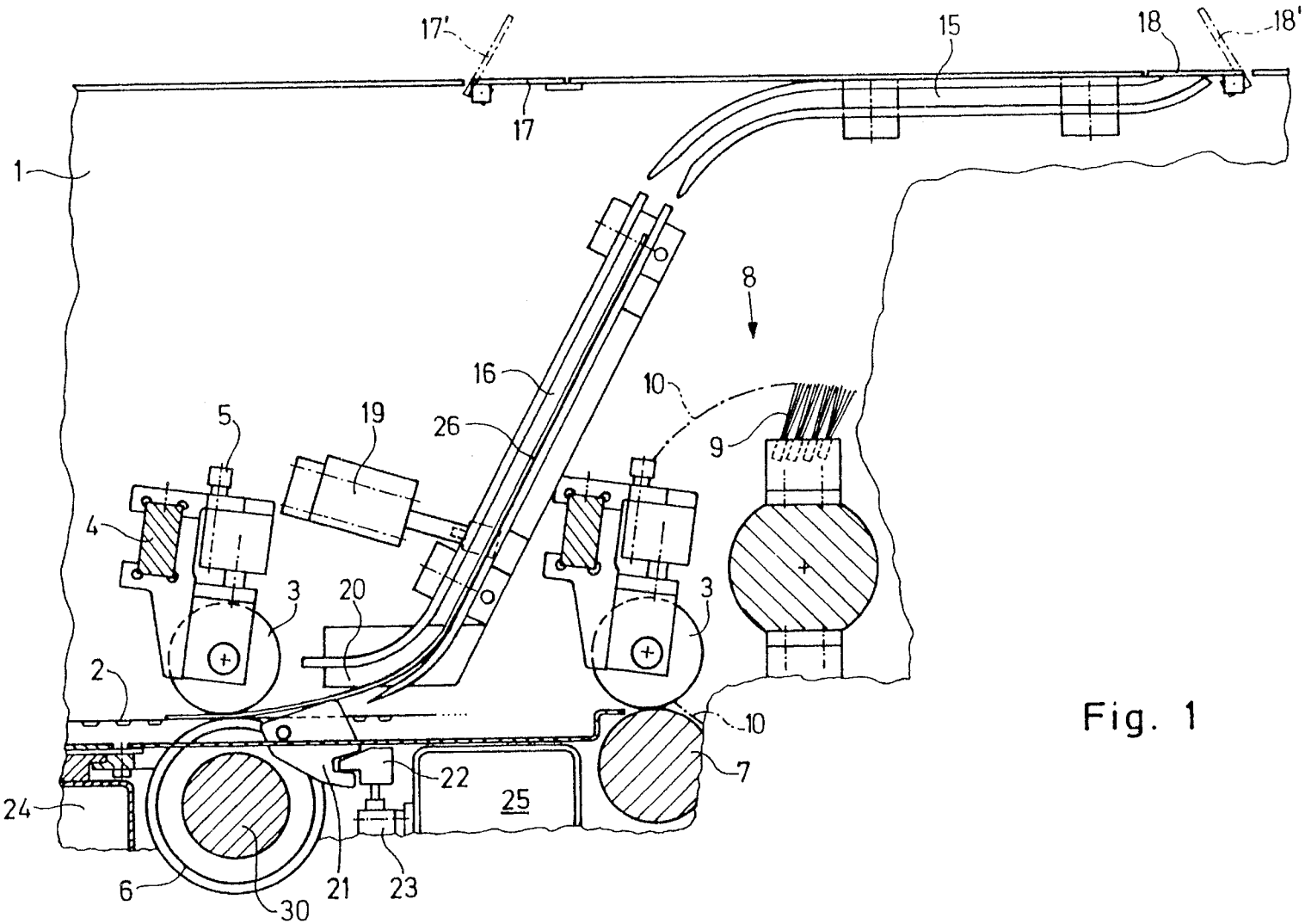
FIG. 1 is a longitudinal sectional view of a rotary cross cutter, extending from a cutting station to a station located downline therefrom at which a copy brake is located.

Referring now to the drawings and, first, particularly to FIG. 1 thereof, there is shown therein a rotary cross cutter 1 wherein engageable first transport rollers 3, only one of which is illustrated in the figure, are rotatably mounted above a copy-transport plane 2 into which individual air-outlet openings are admitted. The individual first transport rollers 3 are attached to a cross-member 4, and the force with which they engage or make contact with a copy is controllable through the intermediary of actuating elements 5. Several mutually adjacent conveying rollers 6, only one of which is illustrated in FIG. 1, are mounted on a drive shaft 30 below the first transport rollers 3. As viewed in a copy-conveying direction from the lower left-hand side to the upper right-hand side of FIG. 1, a conveying roller 7 is situated up-line from a copy brake 8, with second engageable transport rollers 3, only one of which is shown in FIG. 1, being disposed in the aforedescribed manner above the conveying roller 7. The copy brake 8 includes rotating braking cams 9 which describe an envelope curve 10 during the rotation thereof.

Situated above the copy-transport plane 2 in FIG. 1 is a swivellable copy guide 16 on which an inlet funnel 20 is formed, in a lower section of the copy guide 16 directly above the copy-transport plane 2. In the phase of operation shown in FIG. 1, the swivellable copy guide 16 is in engagement or alignment with a stationary copy guide 15. By the thus achieved elongation or extension of the copy guide through the intermediary of the stationary part 15, it is possible, for example at high conveying speeds, to brake individual printing copies 26, the high kinetic energy of which is reduced during the movement thereof through the copy guides 15 and 16. By means of a rear removal flap 18 which has been swung into a position thereof shown in phantom as 18', the copies 26 are either conveyable into a non-illustrated separate container or, alternatively, are directable via non-illustrated guiding devices, which may include blowing-air bars and conveyor belts, to a non-illustrated pile region at the rotary cross cutter 1.

Conversely, however, it is also possible to bring the swivellable copy guide 16 into a virtually vertical position by means of the swivelling device 19, so that it is opposite a front removal flap 17, which is swivellable from a closed position into an opened position thereof shown in phantom at 17'. The copy 26 can also be fed to a sheet pile from the removal flap 17; or, in the case of a continuous stream of shingled or overlapping waste copies 26, the latter may be disposed of by means of the removal flap 17.

Shown below the copy-transport plane 2 is at least one swivel cam 21 which, by means of an actuating head 22 operated through the intermediary of an actuating device 23, extends into the copy-transport plane 2 formed by mutually adjacent floating bars and, as shown, deflects the leading edge of the copy 26 into the inlet funnel 20 of the swivellable copy guide 16. Further situated below the copy-transport plane 2, are an air duct 24, through which there is supplied, inter alia, blowing air for the floating bars in the copy-transport plane 2, and a cross member or traverse 25, which extends across the entire width of the printing press and braces or reinforces the rotary cross cutter 1.

Figure 2:
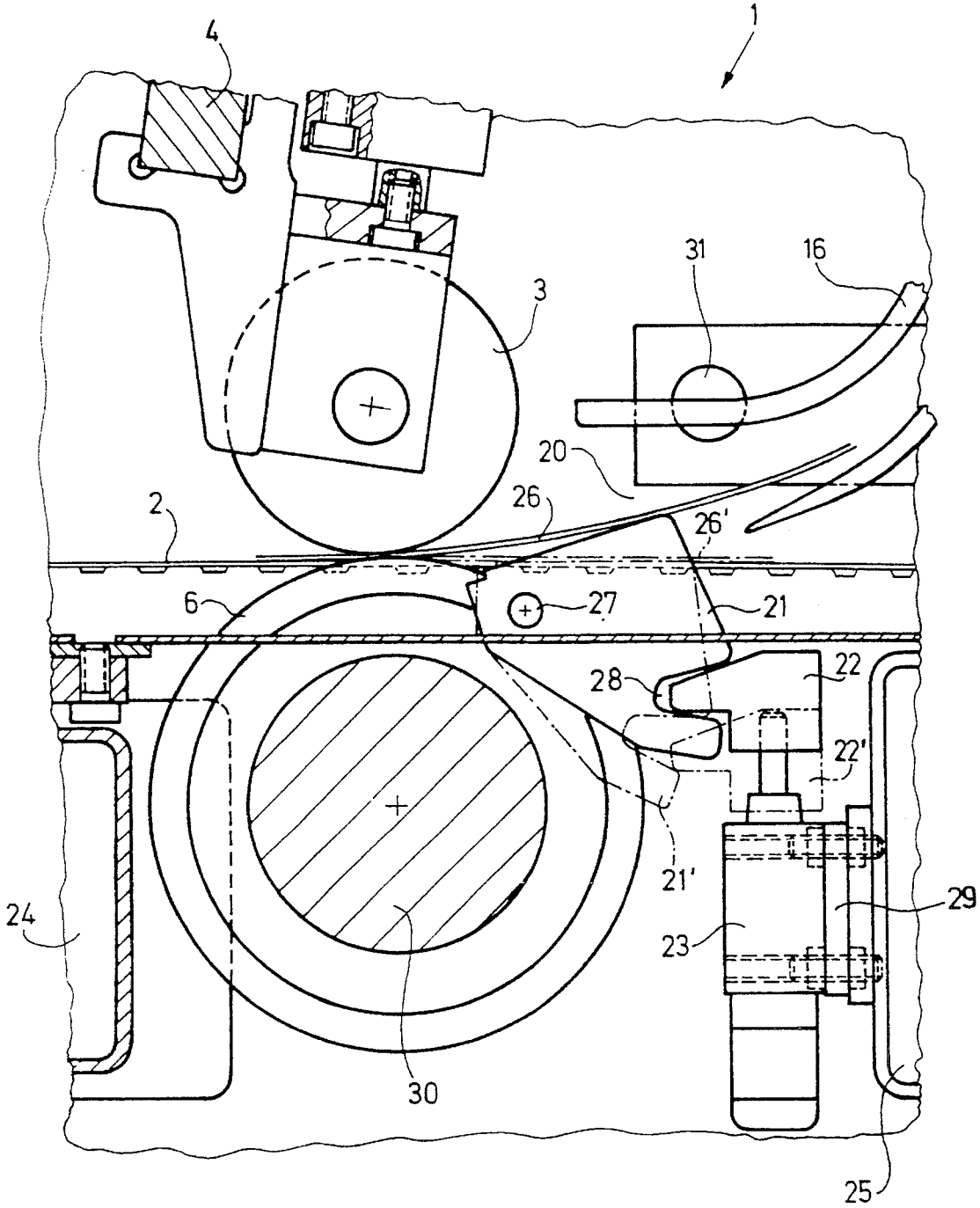
FIG. 2 is an enlarged fragmentary view of FIG. 1 showing in solid lines and in phantom the different positions of swivel cams, actuating elements and a copy located below the copy-transport plane when the swivel cams are activated and deactivated.

FIG. 2 illustrates an enlarged detail of the rotary cross cutter according to the invention.

The copy-transport plane 2, formed of a plurality of mutually adjacent floating bars, accommodates the swivel cams 21, which are movable about a swivel point 27. The solid-line drawing of the swivel cams 21 indicate the extended positions thereof, which upwardly penetrate the copy-transport plane 2. The copy 26 is deflected into the inlet funnel 20 of the swivellable copy guide 16 and, during further transport of the copy 26, it enters the swivellable copy guide 16 completely. The swivellable copy guide 16 is movable about a shaft 31 by means of the swivelling device 19 previously shown in FIG. 1. The upward movement of the swivel cams 21, which may, moreover, also accommodate loosely running rollers which are moved therewith relative to the copies 26 in order, for example, to prevent a set-off of ink, is effected by actuating heads 22 which engage in a recess 28 formed in the cams 21. Minimal actuating distances and extremely short actuating time periods are realizable due to the close approach of the actuating elements 21 and 22 to the copy-transport plane 2. The actuating device 23, for example, in the form of a pneumatic cylinder in the embodiment of FIG. 2, is attached to the cross member 25 by means of a flange connection 29.

The retracted position of the swivel cam 21 is shown in phantom at 21'. In this condition, the edge of the swivel cam 21 deflecting the copy 26 is parallel to the copy-transport plane 2 formed of floating bars. In an analogous manner, the actuating head 22 likewise assumes a retracted position represented in phantom at 22'. The contour of the recess 28 formed in the swivel cam 21 is dimensioned so that an operationally reliable swivelling of the swivel cam 21 is assured. The position of the swivel cam at 26' in FIG. 2 denotes a non-deflected copy 26 remaining in the copy-transport plane 2 and to be conveyed farther.

Figure 3:
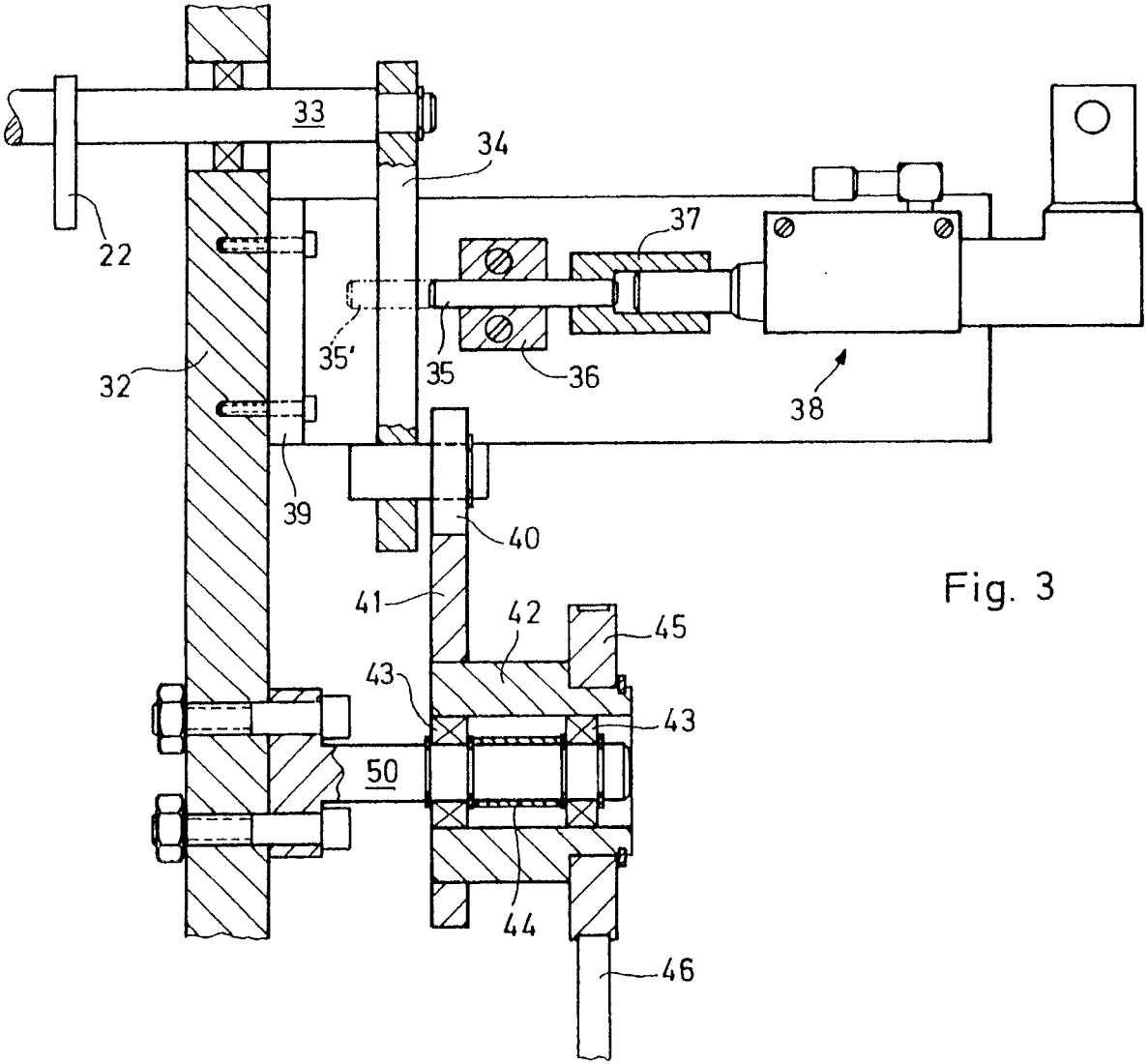
FIG. 3 is a fragmentary, substantially horizontal sectional view of another embodiment of the region below the copy-transport plane of FIG. 2 showing a cam-controlled drive of a shaft with actuating heads.

FIG. 3 is a downwardly seen substantially horizontal sectional view of another embodiment of the invention which includes a cam-controlled drive of a shaft with spaced-apart actuating heads 22. A side wall 32 of the cross cutter 1 is penetrated by a shaft 33 which accommodates a plurality of spaced-apart actuating heads 22. One end of the shaft 33 rotatably mounted in the side walls of the cross cutter holds one end of an arm 34. Situated below the arm 34 is a locking pin 35 which is movable into an extended position 35' shown in phantom below the arm 34. The locking pin 35 is moved in a guide 36, which is connected through the intermediary of a sleeve 37 to an actuating cylinder 38 of a pneumatic unit. The actuating cylinder 38 and the guide 36 are bolted to the side wall 32 by a flange 39. Additionally fastened to the arm 34 is a journal pin on which a roller 40 is rotatably mounted. When the locking pin 35 is retracted, the arm 34 is pulled in a direction towards a control cam 41 by the force of a tension spring.

The approximately kidney-shaped control cam 41 is disposed on a sleeve 42 which is rotatably mounted on a journal pin 50, and additionally accommodates a wheel 45, through the intermediary of which the sleeve 42 and thus the control cam 41 are set in rotation. A toothed belt 46 guided by the wheel 45 assures a non-slip drive of the cam plate 41, which is in phase with the supply of copies.

Figure 4:
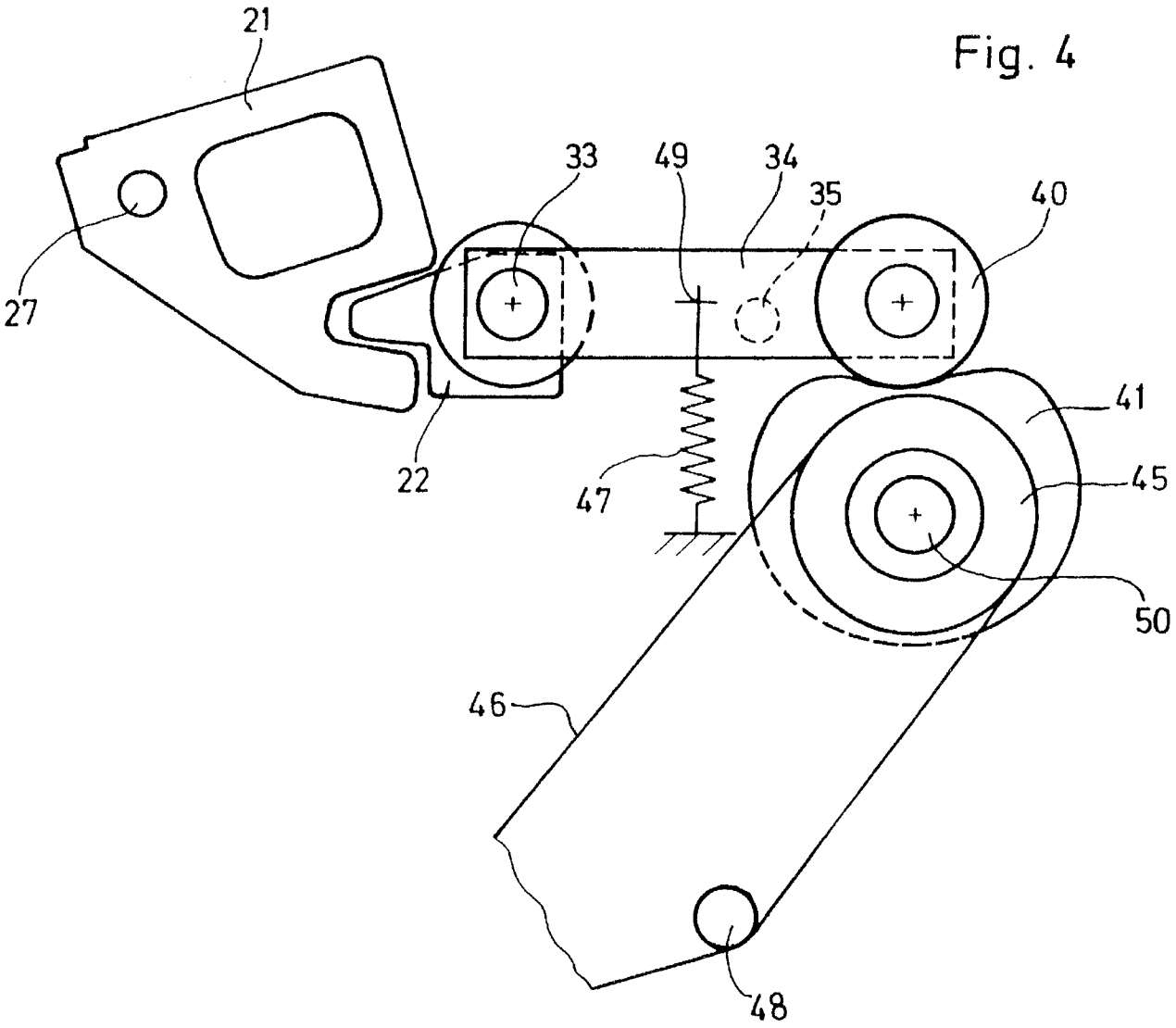
FIG. 4 is a side elevational view from the left-hand side of FIG. 3, showing the actuating-head drive, with a toothed-belt drive being represented.

FIG. 4 is a side view of the actuating-head drive, with the pneumatic unit being omitted. The shaft 33, serving as a rotary bearing, holds one end of the arm 34. Situated approximately centrally on the arm 34 is a connection point 49 through which the force of a tension spring 47 is applied to the arm 34. Shown below the arm 34 is the pin 35, which holds the arm 34 in a position disengaged from the control cam 41. Consequently, when the end of the arm 34 carrying the roller 40 is in an upwardly swung position with respect to FIG. 4, i.e. away from the control cam 41, the ends of the actuating heads 22 on the shaft 33 point downwardly; accordingly, the swivel cams 21 are retracted into the copy-transport plane 2 and are unable to divert or deflect any copies therefrom.

In the phase of operation shown in FIG. 4, a recessed section of the kidney-shaped control cam 41 is disposed opposite the roller 40 of the arm 34. The tension spring 47 engaging the arm 34 at the connection point 49 forces the roller 40 to follow the cam contour and therefore causes the arm 34 to rotate about the shaft 33, which serves as a rotary bearing. Consequently, the lugs of the actuating heads 22 swivel into an approximately horizontal position; the swivel cams 21 extend into the copy-transport plane 2 and cyclically divert copies from the continuous transported shingle or overlapping stream of copies in accordance with the timing prescribed or dictated by the rotating control cam 41. During this cyclical diverting or deflecting motion of the swivel cams 21, which is effected by the rotating control cam 41, the locking pin 35 is in a position removed from the range of motion of the arm 34, i.e., out of the position thereof represented in phantom as 35' in FIG. 3. The deflection or diversion of inspection-copies or waste copies is thereby enabled.

In normal operation, with the continuous conveyance of copies in the copy-transport plane 2, the locking pin 35 moves under the arm 34, thereby cancelling the action of the tension spring 47, as a result of which the roller 40 remains permanently disengaged from the contour of the control cam 41. In this condition, the lugs of the actuating heads 22 are directed downwardly; the swivel cams 21 therefore remain in the positions thereof wherein they are retracted into the copy-transport plane 2.

We claim:

1. Device for removing inspection or specimen copies at rotary cross cutters or deliveries in sheet-fed presses which, at a cutting station, cut a continuously supplied web of material into individual copies subsequently conveyable substantially free of contact and partly mutually overlapping in a given conveying direction in a copy-transport plane to a decelerating station disposed downline from the cutting station, comprising a swivellably mounted copy guide, said copy guide being swivellable into a position adjacent the copy-transport plane, and at least one swivel cam assigned to the copy-transport plane, said swivel cam being activatable for penetrating the copy-transport plane so as to change the conveying direction of the copies into said swivellably mounted copy guide.

2. Device according to claim 1, including a swivel shaft disposed below the copy-transport plane, said swivel cam being deflectable about said swivel shaft below the copy-transport plane.

3. Device according to claim 1, wherein said swivel cam is formed with a recess.

4. Device according to claim 1, including an actuating member with an actuating head, said swivel cam being cooperatively engageable by said actuating head and being movable by said actuating member through the intermediary of said actuating head.

5. Device according to claim 4, wherein said actuating member comprises an actuating cylinder energizable by a pressure medium.

6. Device according to claim 4, including a cam roller connected to said actuating head, said actuating member comprising a control cam on which said cam roller is rollable for activating said swivel cam.

7. Device according to claim 1, including at least another swivel cam disposed adjacent said at least one swivel cam, and said swivellably mounted copy guide being located opposite said swivel cams and having an inlet funnel formed thereon.

8. Device according to claim 7, including a stationary copy guide mounted on the rotary cross cutter, said swivellable copy guide being swivellable into operative alignment with said stationary copy guide.

9. Device according to claim 8, including means for removing copies from a rearward location of said stationary copy guide.

10. Device according to claim 9, wherein said copy-removing means have an opening coverable by a hinged flap.

11. Device according to claim 7, including means for removing copies from an upper part of the rotary cross cutter, said swivellable copy guide being swivellable into operative alignment with said copy-removing means.

12. Device according to claim 11, wherein said copy-removing means have an opening coverable by a hinged flap.

13. Device according to claim 1, wherein said swivellably mounted copy guide is disposed opposite said at least one swivel cam, and a remotely controllable swivelling device operatively engageable with said swivellable copy guide for swivelling said copy guide.

14. Device for removing inspection or specimen copies at rotary cross cutters or deliveries in sheet-fed presses which, at a cutting station, cut a continuously supplied web of material into individual copies subsequently conveyable substantially free of contact and partly mutually overlapping in a given conveying direction in a copy-transport plane to a decelerating station disposed downline from the cutting station, comprising at least one swivel cam assigned to the copy-transport plane, said swivel cam being activatable for penetrating the copy-transport plane so as to change the conveying direction of the copies, an actuating member with an actuating head, said swivel cam being cooperatively engageable by said actuating head and being movable by said actuating member through the intermediary of said actuating head, a cam roller connected to said actuating head, said actuating member comprising a control cam on which said cam roller is rollable for activating said swivel cam.

* * * * *